US006523185B1

(12) United States Patent
Moore et al.

(10) Patent No.: US 6,523,185 B1
(45) Date of Patent: Feb. 25, 2003

(54) SELF-LOWERING TOILET SEAT

(76) Inventors: Randolph J. Moore, 122 Hickory Knoll Dr., Wilmington, NC (US) 28409; William H. Mercier, 122 N. Hampton Dr., Wilmington, NC (US) 28409

( * ) Notice: Subject to any disclaimer, the term of this patent is extended or adjusted under 35 U.S.C. 154(b) by 0 days.

(21) Appl. No.: 09/995,114

(22) Filed: Nov. 27, 2001

(51) Int. Cl.[7] ..... A47K 13/10

(52) U.S. Cl. ..... 4/246.2; 4/248; 16/341; 188/307

(58) Field of Search ..... 4/246.2, 248; 188/307; 16/58, 341

(56) References Cited

U.S. PATENT DOCUMENTS 1,970,008 A * 8/1934 Larson ..... 16/58
5,279,000 A 1/1994 Mercier et al.
6,035,454 A * 3/2000 Birchall ..... 4/246.2
6,182,301 B1 2/2001 Krueger et al.

* cited by examiner

*Primary Examiner*—Charles E. Phillips
(74) *Attorney, Agent, or Firm*—MacCord Mason PLLC

(57) ABSTRACT

A device is described for automatically lowering a toilet seat. The device includes a fluid chamber with a sidewall; a replaceable insert with an arcuate inner face and parallel seat-raised and seat-lowered edges against the sidewall. A vane with a seat-attached shaft, pivotal around a horizontal axis on the opposite side of the chamber, includes a shaft-attached paddle with a flexible distal end in brushing engagement with the insert. The distance between the insert wall and the horizontal axis decreases from the seat-raised edge to the seat-lowered edge increasing the resistance to pivoting of the vane, and thereby to lowering of the toilet seat as the seat descends. Different inserts can be used for different weight seats. The device can also include an adjustable seat stop to compensate for non-level toilets.

20 Claims, 3 Drawing Sheets

SELF-LOWERING TOILET SEAT

BACKGROUND OF THE INVENTION (1) Field of the Invention

The present invention relates generally to toilet seats that include a seat hinge assembly to return the toilet seat to a horizontal or lowered position from a vertical or raised position in a controlled manner, and in particular to assemblies of this type that can be readily adapted for use with toilet seats of different weights.

(2) Description of the Prior Art

Conventional toilet seats include a seat section and a lid section, joined at their back edges to a hinge that is secured to the toilet basin so that the lid section or both sections can be raised manually to a vertical position, or subsequently lowered to a horizontal position. Unfortunately, many males after manually raising the toilet seat to use the toilet as a urinal fail to lower the toilet seat to the horizontal position when finished. As a result, much marital strife has resulted when females who later wish to use the toilet find the seat in its raised position.

Numerous devices are described in the prior art purporting to address this problem. Generally, these devices comprise a hinge that includes a spring that is compressed when the lid is raised, to thereby urge the seat back toward a horizontal position, and means to retard movement of the seat, so that the seat is slowly lowered to its horizontal position. Other hinges include a fluid cylinder in which fluid is transferred from a first chamber to a second chamber when the seat is raised. The seat, which is raised to less than vertical, is slowed in its return to the horizontal position by flow of the fluid through a restricted orifice back to the first chamber.

One example of an automatic toilet seat lowering device of this latter type is found in U.S. Pat. No. 5,279,000, issued Jan. 18, 1994 to Mercier et al. The present inventor is one of the joint inventors of the invention described in that patent. The toilet seat lowering hinge described in the '000 patent is comprised of a housing that includes a horizontal cylindrical chamber attached to the toilet basin; and a vaned shaft axially aligned within the chamber and attached to the toilet seat. A paddle extends radially from the shaft, with the distal end of the paddle brushing against the inner wall of the chamber when the shaft is rotated. A baffle extends from the inner wall of the chamber wall into engagement with the shaft opposite the vane, thereby dividing the chamber into first and second compartments.

The chamber is partially filled with an operating fluid, such as oil. A first vent is positioned in either the baffle or the vane to permit the fluid to flow from one compartment to the other compartment of the chamber as the toilet seat is raised, and a second vent is used to permit fluid to return to the first compartment as the seat is lowered by gravity.

When the toilet seat is manually raised, fluid flows through the one-way valve and the vent from the first compartment to the second compartment. A stop is positioned in the path of the seat to prevent the seat from being raised entirely to the vertical position. Therefore, the weight of the seat urges the seat back to the horizontal position. However, the restricted flow of the fluid back through the vent into the first chamber prevents rapid movement of the seat, resulting in the seat being gently lowered to its horizontal position.

While the Mercier et al. device has proven to be satisfactory for its intended purpose, further improvements are desired in order to improve the device's durability, and increase control over lowering of the toilet seat, while still providing a device that is economical to manufacture and maintain.

In particular, there is a need for a toilet seat-lowering device that can be easily modified for use with different weight toilet seats. When a toilet seat is lowered by gravity from the raised, slightly less than vertical, position to the horizontal position, the gravitational force exerted increases proportionally to the reduced angle of the seat relative to its horizontal position. The force is proportionally to the weight of the seat. Thus, if the same resistance is exerted by a hinge assembly on seats of different weights, the heavier seat will descend at a greater speed, and may strike the upper surface of the toilet with considerable force, resulting in a large noise and risk of damage to the seat or lowering mechanism.

Ideally, the level of resistance exerted against toilet seats should be proportional to the weight of the toilet seat, so that any given toilet seat would gently descend to its lowered position. Heretofore, it has been possible to accomplish this object only by custom designing each toilet seat lowering device to the weight of a single seat. This approach is not only expensive, but results in the need for a large inventory. Instead, there is a need for a toilet seat lowering device that can be easily and inexpensively adapted for use with toilet seats having a range of weights.

When connected to a toilet seat lowering device, the toilet seat in the fully raised position must be at an angle of slightly less than vertical in order to return to the horizontal position. Thus, toilet seat lowering devices are designed to stop the toilet seat in this position. The design of prior art devices in this respect, however, assumes that the toilet is on a level surface, which is seldom the case in most home bathrooms. As a result, many devices will not perform as intended. Thus, there is also a need for a toilet seat lowering device that can be adjusted to compensate for non-level surfaces.

SUMMARY OF THE INVENTION

The present invention relates to a toilet seat lowering device that operates on the same principal as the Mercier device described in the above '000 patent, but with modifications to address the above needs. Like the device of the '000 patent, the present device is comprised of housing including a fluid chamber secured to the toilet basin, and a pivotal vane that divides the chamber into two compartments. The seat is attached at its rear edge to the vane, so that lifting of the seat from a horizontal position to a generally vertical position pivots the vane within the housing from a seat-lowered position to a seat-raised position, forcing the operating fluid from one chamber to the other chamber through a first opening, which preferably is a one-way valve. When the seat is returned to the horizontal position by gravity, a second opening in the vane permits the fluid to return to the initial compartment.

While similar in many aspects to the earlier Mercier et al. device, the toilet seat lowering assembly of the present invention also includes features that specifically address the deficiencies in prior art designs. Specifically, the device of the present invention can be quickly and inexpensively modified to compensate for different toilet seat weights. In addition, the device can be easily adjusted to compensate for non-level floor conditions.

Generally, the housing includes a horizontally elongated fluid chamber and means to attach the housing to a toilet basin. The fluid chamber may be of various configurations. For purposes of the present description, the chamber will be described as having opposed first and second side walls, upper and lower walls connecting the side walls, and opposed end walls. Preferably, the upper wall is a generally horizontal planar wall, so that the toilet seat can be raised to the slightly less than vertical position without contacting the toilet seat lowering device, and without requiring relocation of the toilet seat.

The vane is comprised of a shaft rotatably or pivotally mounted along a horizontal axis and a paddle with an inner end attached to the shalt, and a distal end extending to the side of the chamber, dividing the chamber into first and second compartments. The vane is pivotal between first and second positions changing the relative volumes of the compartments. The vane is preferably formed of a steel cylindrical rod or shaft having opposed ends, with the paddle being in the form of a plastic sleeve that is molded around the rod. The paddle includes first and second opposed faces, and side edges brushingly engaging the end walls of the chamber. One or more reinforcing brace segments may extend outwardly from one or both faces, with each brace segment having an inner end integral with the sleeve, to prevent flexing or breakage of the paddle.

The vane paddle includes two fluid ports or openings, the first opening is preferably a one-way valve that is opened by fluid pressure when the toilet seat is raised, permitting fluid to flow rapidly from one side of the paddle to the other. The second opening permits fluid to slowly return to the initial side of the paddle as the toilet seat is lowered, thereby controlling the downward movement of the toilet seat. The second valve may also be a one-way valve, opening only when the seat is lowered. However, the valve may also be designed to open in both directions, thereby providing another opening for movement of fluid when the toilet seat is raised, or may simply be an orifice extending from one face of the paddle to the other. One or both of the valves may be adjustable to control the rate of fluid flow.

In the prior Mercier et al. device, one wall of the chamber has an arcuate or inwardly curved face with first and second horizontal side edges, and opposed ends. The length of the paddle is such that the distal end of the paddle brushes against the arcuate wall as the vane rotates under gravity from the seat-raised position to the seat-lowered position. The paddle distal end is snugly against the arcuate wall, and slightly flexible, so that there is minimal fluid leakage between the paddle and the arcuate wall.

If the arcuate wall has an equal radius along its entire surface between the opposed side edges, the resistance exerted by the wall against the paddle distal end, and thereby rotation of the shaft, will be the same from the seat-raised position to the seat-lowered position. However, the force exerted by the seat increases as it is lowered due to the increasing moment arm resulting from the decreasing angle, relative to horizontal, of the seat. Therefore, the seat momentum increases as it is lowered, resulting in the seat slapping onto the toilet, instead of being gently lowered.

However, in accordance with the present invention, an insert with an inner arcuate wall is positioned against the chamber wall for contact with the distal end of the vane with the distance between the arcuate wall and the horizontal axis of the vane shaft progressively decreasing from a first, or seat-raised, edge to a second, or seat-lowered, edge of the arcuate wall. As a result, the resistance against the paddle distal end progressively increases as the vane is rotated during lowering of the toilet seat, thereby decreasing the rate of descent of the seat.

Inserts of different configurations may be selected for toilet seats of different weights. With proper selection of the change in distance from the arcuate wall to the horizontal axis, taking into account the weight and size of the seat, the seat can be caused to slowly descend at a constant rate from the seat-raised position to the seat-lowered position.

Thus, in its broad aspect, the automatic toilet seat lowering assembly of the present invention is comprised of a housing that includes a fluid chamber having a first wall; a replaceable or selectable insert with first and second, horizontal edges, and an inwardly curved inner face positionable against the first wall; and a vane dividing the chamber into first and second compartments, the vane including a shaft pivotal about a horizontal axis between a seat-raised position and a seat-lowered position, and a paddle attached to the shaft, the paddle having a flexible distal end in brushing engagement with the inner surface of the first wall, the radius of curvature of the first wall inner surface decreasing from the first edge to the second edge, the paddle distal end being adjacent the first edge when in the seat-raised position and adjacent the second edge when in the seat-lowered position.

The configuration of the outer face generally conforms to the chamber wall, so that the insert can be securely attached. In a preferred embodiment, the outer face of the insert is also arcuate with a radius of curvature relative to the horizontal axis being constant, and the housing wall is of a corresponding arcuate configuration, so that the outer face of the insert conforms to the housing wall.

Thus, in the preferred embodiment, the insert is a curved rectangular plate with opposed first and second edges, having an arcuate outer face of a constant radius and an increasing thickness from the first to the second edge, resulting in a progressively decreasing distance between the insert inner face and the horizontal axis of the vane shaft. Therefore, as the distal end of the paddle is brushed against the inner face as the seat is lowered, there is increased resistance against the distal end of the paddle, thereby slowing rotation of the vane and the rate of descent of the seat.

By inclusion of the insert, one device can be used in connection with toilet seats of various weights, simply by selecting an insert configuration that corresponds to the toilet seat weight. Generally, the difference between the distance between the horizontal axis and the seat-lowered edge of the insert (Distance A) compared to the distance between the horizontal axis and the seat-raised edge (Distance B) will increase in proportion to the weight of the toilet seat. As a general guide, the difference between Distance A and Distance B will be from about 0.005 to about 0.025 inch.

In order to initiate lowering of the toilet seat, some fluid must first flow from one of the chambers to the other, permitting movement of the paddle. Some of this fluid may flow through the valve in the paddle. However, the rate of flow, due to the low force exerted by the seat in its fully raised position, may be quite slow. In order to initiate movement of the seat, the insert may be notched along its seat-raised edge, providing an additional channel for movement of fluid. It is only necessary for this notch to extend in the direction of the seat-lowered edge of the insert for a short distance, since the weight of the seat will exert a sufficient force against the fluid after descent has been initiated. Preferably, the notch is V-shaped, i.e., of reduced width toward the seat-lowered edge of the insert, so that the size of the gap decreases as the paddle moves toward the seat-lowered side of the insert. Generally, the notch will have a length of only about 3 to about 10% of the distance between the seat-raised and seat-lowered edges of the insert.

Preferably, the horizontal axis of the vane axle is located adjacent a second wall on the opposite side of the chamber from the insert, so that the paddle extends across the chamber. The second wall may include a semi-circular recess to partially surround the vane shaft, and the vane may brush against the second chamber wall, preventing seepage of fluid between the second wall and the vane. For ease of movement and reduced wear, the gap between the vane and the second wall is preferably closed with flexible fins or baffles that extend outwardly from the vane into brushing engagement with the wall. Alternatively, the flexible fins can extend from the wall into engagement with the sleeve.

The housing also includes openings at each end of the chamber, so that opposed ends of the shaft project outwardly through the ends of the housing for connection to the toilet seat attachment arms. O-rings may be positioned about the shaft ends to ensure a proper seal between the housing and the shaft, thereby preventing fluid leakage. When a user sits on the toilet seat, the vane is pressed downwardly against the housing. Cylindrical support rings may also be positioned in the present device at the outer ends of the shaft to engage the housing, preventing pressure against the O-rings, and thereby avoiding degradation or distortion of the O-rings, and resultant fluid leakage.

On occasion, it may be desirable to quickly lower the toilet seat instead of waiting for it to be lowered by gravity. Therefore, the distal end of the vane is flexible so that fluid will flow between the end of the vane and the arcuate wall surface when the toilet seat is forced downwardly. Alternatively, or in addition, the one-way valve described above can be designed to open in the opposite direction upon the exertion of sufficient force.

As noted previously, prior art toilet seat lowering assemblies have been designed with the assumption that the assembly will be used with a toilet that in mounted on a level floor. In reality, however, floors are seldom exactly level. As a result, orientation of the toilet seat at the slightly less than vertical, e.g., 88° to 85° above horizontal, required for proper functioning of the toilet seat may not be achieved. Instead, the seat in the fully raised position may be vertical or beyond vertical, in which case the seat will not automatically return to its lowered position, or at substantially less than vertical, preventing the seat from staying in the raised position for at least a minute or so.

The present assembly addresses this prior art deficiency by incorporating an adjustable stop to determine the position of the toilet seat in the fully raised position. Generally, this stop is positionable between the assembly housing and an attachment arm, and is adjustable between a fully retracted position in which the seat is permitted to move to a maximum raised position, and a fully extended position preventing the seat to be moved beyond a minimum raised position. Preferably, the stop is a threaded rod positioned in the housing, with a forward cap that is in the path of rotation of one of the attachment arms, so that the cap engages the attachment arm when the seat is in the fully raised position.

In operation, the toilet seat is manually raised from the seat-lowered position to the slightly less than vertical seat-raised position, pivoting the distal end of the attached vane paddle toward the seat-raised edge of the replaceable insert of the arcuate wall. A first fluid transfer opening, preferably a one-way valve, in the paddle permits operating fluid, compressed by the paddle, to flow from a first compartment into a second compartment. Additional fluid will initially flow through the notch in the seat-raised edge of the insert until the paddle has begun its initial movement.

As the seat descends toward the seat-lowered position, the distal end of the vane paddle brushes against the inner curved wall of the insert. Since the distance between the insert inner face and the vane's horizontal axis decreases from the seat-raised edge of the replaceable insert to the seat-lowered edge, increasing resistance will be encountered by the distal end of the paddle as the seat descends. As a result, with selection of the rate of change in the insert radius based on the weight of the seat, the rate of seat descent can be maintained constant.

If the user determines that the seat, due to unevenness of the toilet, does not descend after being raised, or if the seat does not stay in the raised position for sufficient time, the user can simply extend or retract the adjustable stop until proper functioning of the assembly results.

Other aspects of the present invention will become apparent to those skilled in the art after a reading of the following description of the preferred embodiment.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 1:
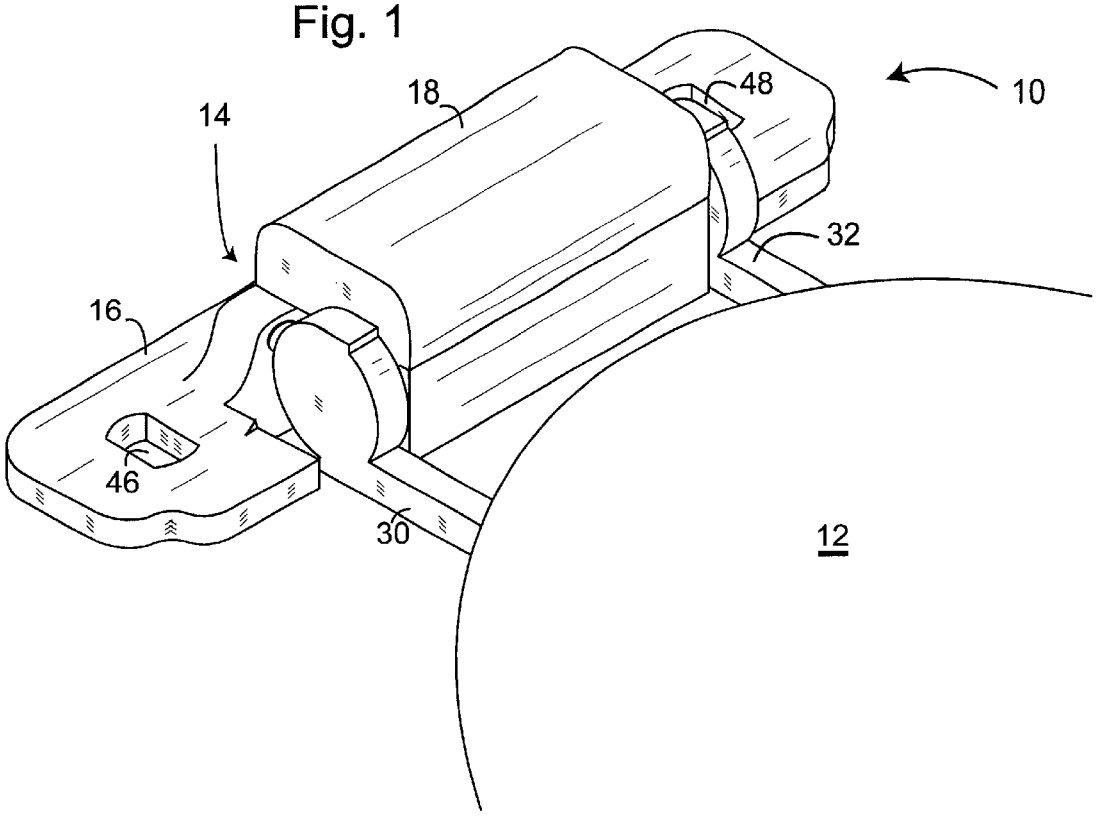
FIG. 1 is a perspective view of the toilet seat assembly and an attached toilet seat.
Figure 2:
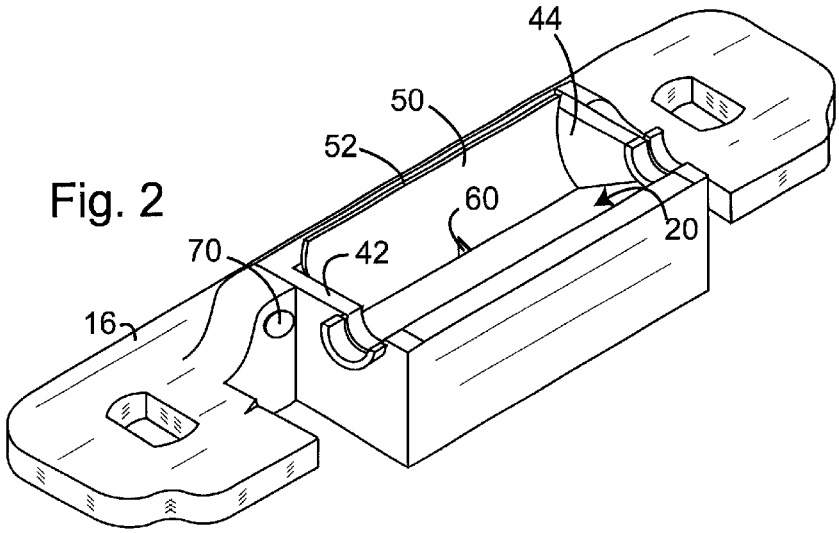
FIG. 2 is a perspective view of the bottom section of the assembly housing showing the replaceable insert in position.
Figure 3:
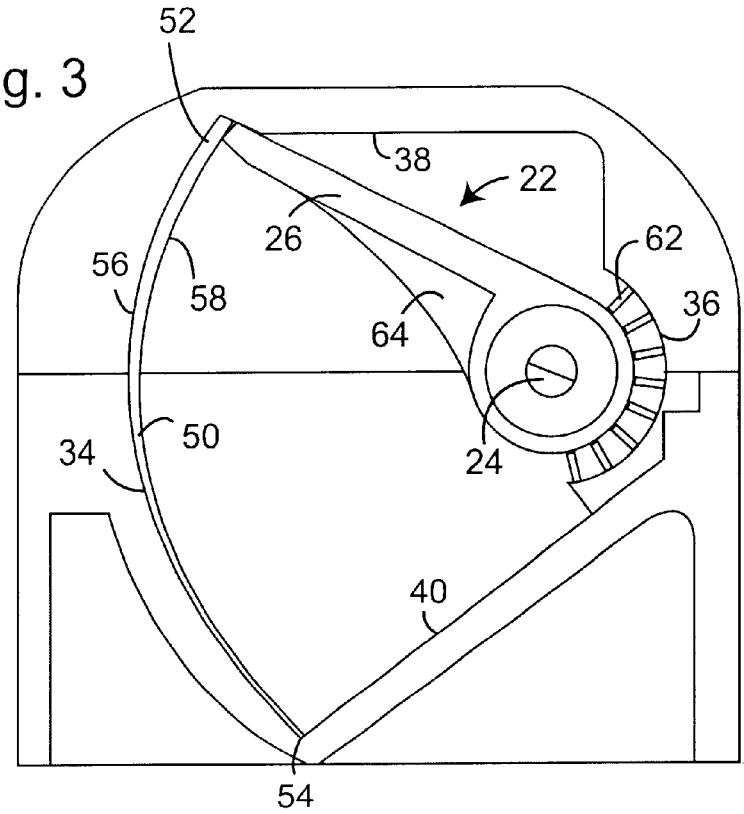
FIG. 3 is a sectional end view of the device when the toilet seat is in the lowered position.
Figure 4:
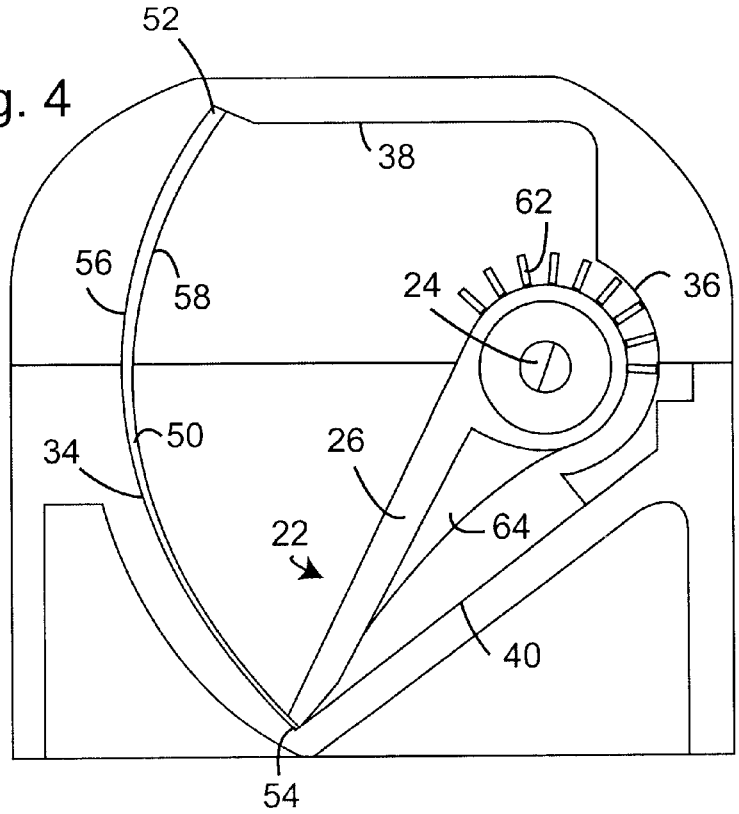
FIG. 4 is a sectional end view of the device when the toilet seat is in the raised position.
Figure 5:
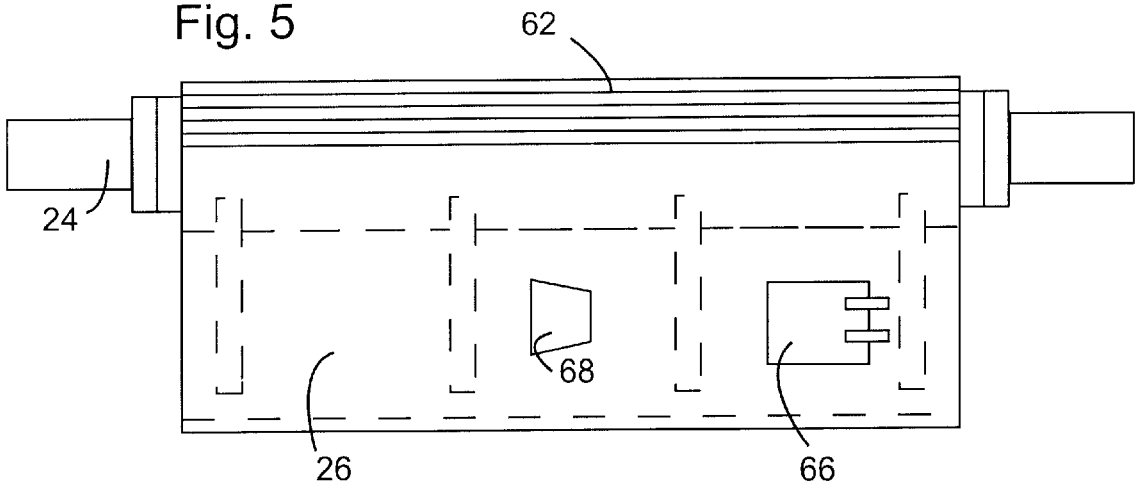
FIG. 5 is a top view of the vane.
Figure 6:
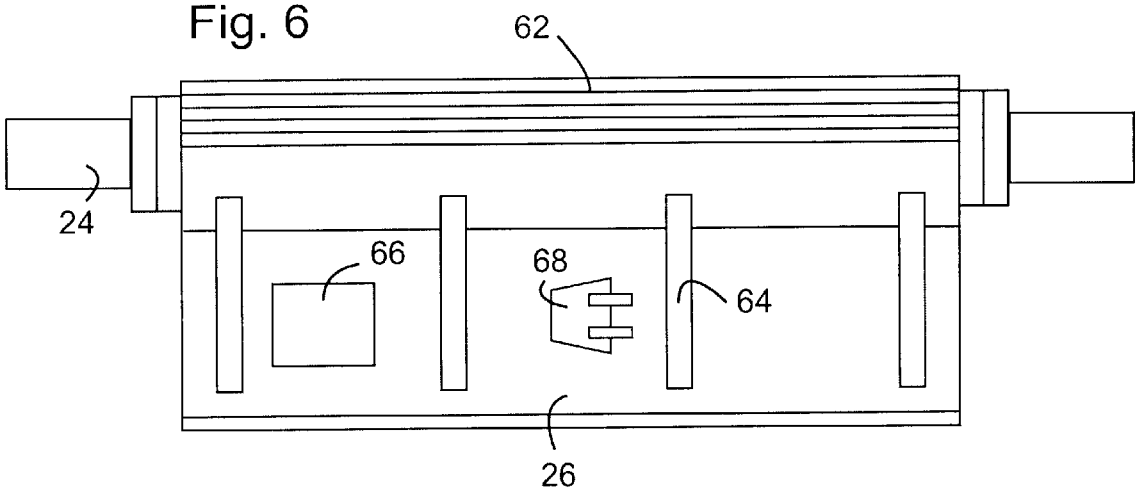
FIG. 6 is a bottom view of the vane.

FIG. 1 illustrates the toilet seat lowering assembly, generally 10, attached to a toilet seat, generally 12. Assembly 10 may be sold as a unit with toilet seat 12. Preferably, however, assembly 10 is sold separately with the toilet seat, with the appropriate insert for a given type of toilet seat being preinstalled in the assembly, or sold separately for installation by the purchaser.

Assembly 10 is comprised of housing 14, formed by joining lower housing section 16 and an upper housing section 18. Housing 14 includes a chamber 20 to hold an operating fluid, not shown, and a vane 22. Vane 22 is comprised of shaft 24 having ends shaped to fit into receiving openings in attachment arms 30 and 32, that are used to attach seat 12 to assembly 10, and paddle 26 that extends from shaft 24 to a slightly flexible distal end or edge.

Chamber 20 is comprised of a first and second opposed side walls, 34 and 36, respectively. The upper edges offside walls 34 and 36 are joined by an upper, planar and horizontal wall 38, while the lower edges of side walls 34 and 36 are joined by 20 lower wall 40. Housing 14 also includes bore-containing end walls. Lower housing section 16 also includes mounting openings 46 and 48 to attach assembly 10 to a toilet bowl, not shown.

Replaceable insert 50, attached to the inner face of side wall 34, is comprised of a curved rectangular plate with opposed upper and lower edges 52 and 54. Insert 50 has an arcuate outer face 56 of a constant radius to fit snugly against the inner face of side wall 34, and an arcuate inner face 58. Insert 50 increases in thickness from the first to the second edge, resulting in a progressively decreasing distance between insert inner face 58 and the horizontal axis of vane shaft 24. That is, the radius of curvature of inner face 58 decreases from lower edge 54 to upper edge 52. Lower edge 54 includes a triangular notch 60. Vane paddle 26 extending across chamber 20 from an inner end integral with shaft 24 to a distal end in brushing engagement with inner face 58, while the side edges of paddle 26 brush against end walls 42 and 44 to prevent fluid leakage. A plurality of flexible fins or baffles 62 extend outwardly from the inner end of vane 22 into brushing engagement with a semi-circular horizontal recess in side wall 36 to prevent fluid leakage between vane 22 and wall 36.

Paddle 26 includes a plurality of reinforcement segments 64 integral with the lower surface of paddle 26 to provide rigidity to paddle 26 except at its distal edge, which is tapered for flexibility as the distal end progresses from lower edge 54 to upper edge 52. Paddle 26 also includes a one-way valve 66 that opens toward the top of paddle 26 when seat 12 is lifted, allowing fluid to flow from beneath paddle 26 to above paddle 26. Paddle 26 also includes a one-way return valve 68 designed to open under fluid pressure on the top side of paddle 26 created by the weight of the toilet seat, so that fluid can flow back beneath paddle 26. Segments 64 are concave to provide a channel for the transfer of fluid between compartments.

The fully raised position of seat 12 is determined by a horizontally positionable stop 70 mounted in housing 14 and having a forward contact cap positioned within the path of movement of attachment arm 30, so that the rear face of arm 30 engages stop 70. Stop 70 may be, for example, a threaded rod that is turned to extend or retract stop 70 within housing 14.

In operation, seat 12 is manually raised to slightly less than vertical. The upper position of seat 12 is determined by the positioning of stop 70. As seat 12 is raised, operating fluid is forced through valve 66 to the top of paddle 26. After seat 12 is raised, fluid begins to return to beneath paddle 26 through valve 68, and also through notch 60.

Seat 12 then begins to descend toward the horizontal position, closing notch 60. As the distal end of vane 22 brushed upward along inner face 58 of insert 50, the resistance to rotation of shaft 24, and thereby to the descent of seat 12 increases, compensating for the greater force exerted by seat 12 as the angle of seat 12 above horizontal decreases. Thus, with proper selection of replaceable insert 50, the rate of descent of seat 12 can be maintained constant from the fully-raised position to the fully-lowered position.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. An automatic toilet seat-lowering device for automatically lowering a toilet seat from a seat-raised position to a seat-lowered position comprised of:

a) a housing including a fluid chamber having a first wall;

b) a replaceable insert having an outer face adjacent said first wall and an inner face, said insert having parallel seat-raised and seat-lowered edges; and c) a pivotal vane including an inner end pivotal around a horizontal axis spaced from said insert inner face and a flexible distal end in brushing engagement with said insert inner face, the distance between said insert inner face and said horizontal axis decreasing from said seat-raised edge to said seat-lowered edge.

2. The device of claim 1, wherein said first wall is a side wall, said seat-raised edge is the lower edge of said insert, and said seat-lowered edge is the upper edge of said insert.

3. The device of claim 1, wherein said insert includes a notch in its seat-raised edge.

4. The device of claim 1, wherein said housing first wall is inwardly curved, and said insert includes an outer wall having a curvature corresponding to the curvature of said housing first wall.

5. The device of claim 1, further including an adjustable toilet seat stop to determine the seat-raised position of a toilet seat.

6. The device of claim 1, wherein said vane includes a shaft aligned along said horizontal axis, said shaft having opposed ends projecting from said housing, said device further including toilet seat attachment arms extending from the opposed ends of said shaft.

7. An automatic toilet seat-lowering device having a seat-raised position and a seat-lowered position comprised of:

a) a housing including a fluid chamber having a side wall:

b) a replaceable insert having an outer face adjacent said side wall, an arcuate inner face, and horizontal, parallel lower and upper edges; and c) a pivotal vane including a shaft pivotal around a horizontal axis on the opposite side of said chamber from said insert and a paddle extending from said shaft to a flexible distal end in brushing engagement with said insert, the distance between said insert inner face and said horizontal axis decreasing from said lower edge to said upper edge, said paddle distal end being adjacent said lower edge when said device is in the seat-raised position and adjacent said upper edge when said device is in the seat-lowered position.

8. The device of claim 7, wherein said insert includes a notch in its seat-raised edge.

9. The device of claim 7, further including an adjustable toilet seat stop to determine the seat-raised position of a toilet seat.

10. The device of claim 7, wherein said vane includes a shaft aligned along said horizontal axis, said shaft having opposed ends projecting from said housing, said device further including toilet seat attachment arm attached to the opposed ends of said shaft.

11. The device of claim 7, wherein said vane includes an axle longitudinally aligned with said horizontal axis, said axle having opposed ends, said device further including seat attachment arms attached to said ends, said housing including an adjustable stop positioned to contact one of said seat attachment arms when said vane is in the seat raised position.

12. The device of claim 7, wherein said vane includes a first fluid transfer opening permitting movement of a fluid from said first compartment to said second compartment when said vane is pivoted to the seat-raised position, and a second fluid transfer opening permitting movement of a fluid from said second compartment to said first compartment when said vane is pivoted to the seat-lowered position.

13. The device of claim 7, wherein said housing is comprised of upper and lower attachable sections, said upper section including a horizontal, planar top surface.

14. A combination toilet seat and device for automatically lowering said toilet seat from a raised position to a lowered position, said device comprising:

a) a housing including a fluid chamber having a first side wall;

b) a replaceable insert having an outer face adjacent said side wall, an arcuate inner face, and horizontal, parallel lower and upper edges;

c) a pivotal vane including a shalt with opposed ends, said shaft being pivotal around a horizontal axis on the opposite side of said chamber from said insert and a paddle extending from said shaft to a flexible distal end in brushing engagement with said inserts the distance between said insert inner face and said horizontal axis decreasing from said lower edge to said upper edge, said paddle distal end being adjacent said lower edge when said device is in the seat-raised position and adjacent said upper edge when said device is in the seat-lowered position; and d) attachment arms joining said seat to the opposed ends of said shaft.

15. The device of claim 14, wherein said vane includes a fluid transfer opening permitting movement of a fluid between said first and second compartments when said vane is pivoted about said axis to move said distal end from said second end to said first end.

16. The device of claim 14, wherein said housing includes a second wall section on the opposite side of said fluid chamber from said first wall section, said horizontal axis being adjacent said second wall section.

17. The device of claim 14, wherein said seat-raised edge being beneath said seat-lowered edge.

18. The device of claim 14, wherein said seat-lowered edge is notched.

19. The device of claim 14, further including an adjustable toilet seat stop to determine the seat-raised position of a toilet seat.

20. The device of claim 14, wherein said first side wall is inwardly curved, and said insert includes an outwardly curved outer wall having a curvature corresponding to the curvature of said first side wall.

* * * * *